United States Patent [19]

Rudszinat et al.

[11] 4,330,061

[45] May 18, 1982

[54] METHOD AND APPARATUS FOR DETECTING AND SEGREGATING DEFECTIVE COMMODITIES FROM A SERIES OF DISCRETE COMMODITIES

[75] Inventors: Willy Rudszinat, Dassendorf, Fed. Rep. of Germany; Siegfried Abrahams, Richmond, Va.

[73] Assignee: Hauni-Werke Körber & Co. KG., Hamburg, Fed. Rep. of Germany

[21] Appl. No.: 146,486

[22] Filed: May 15, 1980

[51] Int. Cl.[3] ..... B07C 5/02; B07C 5/36

[52] U.S. Cl. ..... 209/3.1; 209/587; 209/617; 209/707; 209/657; 209/903; 209/536

[58] Field of Search ..... 209/541, 542, 543, 545, 209/540, 587, 617, 618, 707, 657, 903, 3.1, 536; 198/398

[56] References Cited

U.S. PATENT DOCUMENTS

| | | | |
|---|---|---|---|
| 3,540,584 | 11/1970 | Laukaitis | 209/903 X |
| 3,606,014 | 9/1971 | Linn | 209/617 X |
| 3,939,063 | 2/1976 | Epperson et al. | 209/3.1 |
| 4,011,155 | 3/1977 | Feurstein et al. | 209/3.1 |
| 4,053,056 | 10/1977 | Day | 209/617 X |

*Primary Examiner*—Allen N. Knowles

*Attorney, Agent, or Firm*—Kontler & Grimes

[57] ABSTRACT

Cigarette packs which leave a packing machine by moving sideways so that one of the major surfaces of each pack faces forwardly are monitored for the presence of defective envelopes during travel between two endless belt conveyors. When the monitoring system or systems detect a defective pack, such system or systems generate one or more signals which are used to expel the defective pack from the path between the conveyors. The ejection is effected by changing the orientation of defective packs relative to the conveyors so as to reduce the frictional hold of conveyors upon the relatively narrow lateral faces of the defective packs with the result that the thus released defective packs can descend by gravity. The orientation of defective packs can be changed by discrete pins which move into the path of the packs from above, from below or from one side so as to be nearer to the one than to the other conveyor. This causes the defective packs to turn about axes which are located at one side of the central longitudinal vertical symmetry plane of the path for the packs between the two conveyors. That conveyor which is more distant from the axes about which defective packs are caused to turn is flanked by two endless cord-like conveyors which are held in strong frictional engagement with the defective and satisfactory packs so that a portion of a defective pack which is being turned continues to advance with the cord-like conveyors.

49 Claims, 9 Drawing Figures

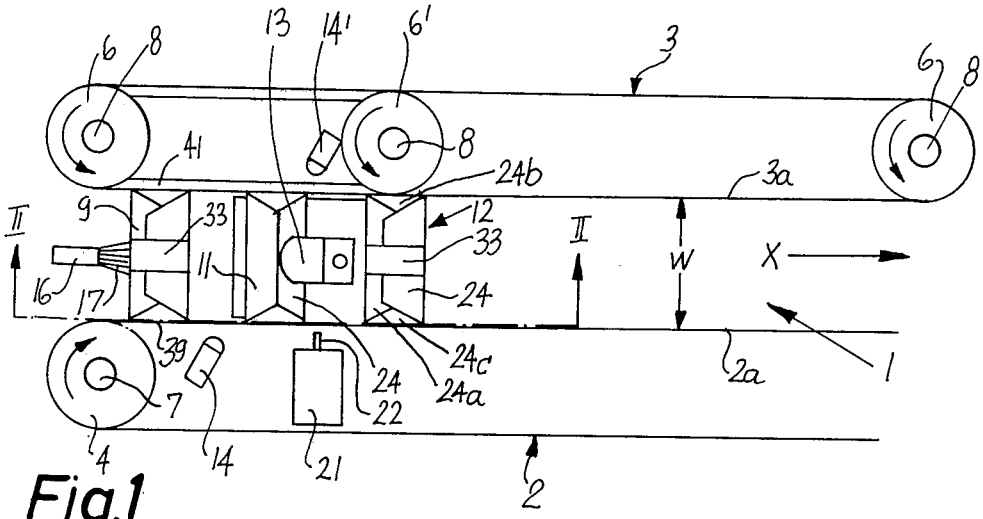
Fig.1
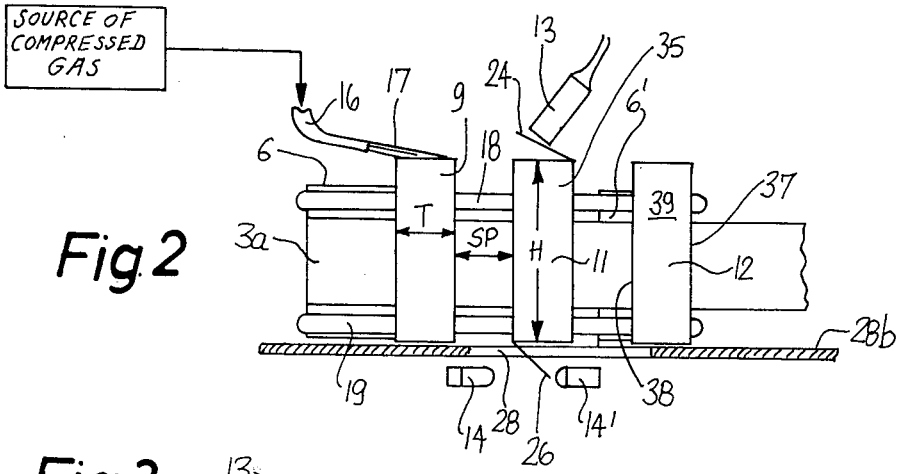
Fig.2
Fig.3
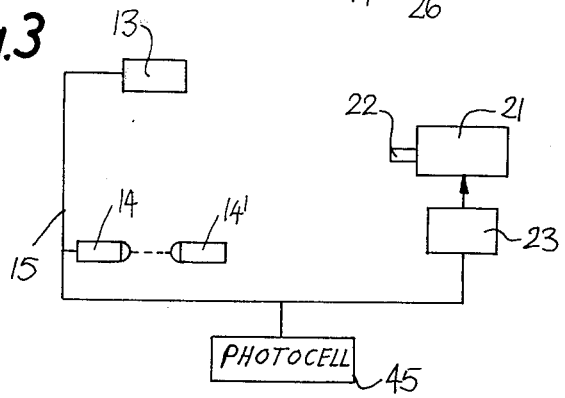

METHOD AND APPARATUS FOR DETECTING AND SEGREGATING DEFECTIVE COMMODITIES FROM A SERIES OF DISCRETE COMMODITIES

BACKGROUND OF THE INVENTION

The present invention relates to detection of defective commodities which travel along a predetermined path and are randomly distributed among satisfactory commodities. More particularly, the invention relates to a method and apparatus for detecting and segregating defective commodities, such as packs of cigarettes or other rod-shaped smokers' products, which are transported along a predetermined path and must be removed from such path while the satisfactory commodites advance through and beyond the monitoring and ejecting stations. Still more particularly, the invention relates to improvements in a method and apparatus for detection and segregation of defective packs which contain cigarettes, cigars or other rod-shaped or particulate smokers' products and whose defectiveness is attributed or attributable (either exclusively and/or among other causes) to the absence of acceptable inner, outer and/or intermediate envelopes for the confined material or articles.

U.S. Pat. No. 4,053,056 granted Oct. 11, 1977 to Day (and corresponding to German Offenlegungsschrift No. 2,731,477 or United Kingdom Pat. No. 1,545,728) discloses an apparatus wherein a series of cigarette packs is transported along an elongated path which is defined by the normally parallel inner reaches of two endless belts trained around pulleys which rotate about vertical axes. The inner reaches of the two belts are driven at the same speed and advance in the same direction to grip the respective sides of successive packs which are introduced into the aforementioned path. The packs are spaced apart from each other. The condition of successive packs of the series of packs in the path between the inner reaches of the two belts is monitored and, when the detector system ascertains the presence of a defective pack, it generates a signal which is transmitted to an ejecting device which increases the distance between the inner reaches of the belts so that the defective packs descend by gravity.

A drawback of the just described patented apparatus is that the mechanism which increases the distance between the inner reaches of the two belts comprises a relatively large number of complex, sensitive and expensive parts. Moreover, the space requirements of the patented apparatus are quite substantial because only one pack can be disposed in the aforementioned path at a time; otherwise, the widening of the path for the purpose of ejection therefrom of a defective pack would or could result in ejection of one or more satisfactory packs which immediately precede and/or follow the defective pack. An additional drawback of the patented apparatus is that the belts are subjected to frequent and quite pronounced stresses so that their useful life is rather limited. Since the path along which the packs advance during testing and/or ejection is relatively long, the output of the apparatus is relatively low except if the belts are driven at an extremely high speed which is likely to interfere with reliable operation of the monitoring means. On the other hand, rapid transport of packs is desirable if the combined monitoring and segregating apparatus is installed immediately downstream of a modern high-speed packing machine which turns out several hundred cigarette packs per minute.

OBJECTS AND SUMMARY OF THE INVENTION

An object of the invention is to provide a novel and improved method of detecting defective commodities in a stream or series of discrete commodities while such commodities advance along a predetermined path, and of segregating defective commodities without fail while the commodities to be segregated are closely adjacent to satisfactory commodities.

Another object of the invention is to provide a method which can be resorted to with advantage for segregation of defective packs for cigarettes or other smokers' products whenever the container for such products exhibits one or more defects, e.g., improperly folded portions of inner, intermediate and/or outer envelopes which may consist of paper, cardboard, metallic foil, plastic material or a combination of these.

A further object of the invention is to provide a method which ensures reliable detection and segregation of defective commodities even if the defective commodities are closely adjacent to preceding or next-following satisfactory commodities.

An additional object of the invention is to provide a method which can be practiced for detection and segregation of defective packs of practically any desired size and/or shape and which can be resorted to for detection and segregation of defective packs without in any way affecting the position, condition and/or appearance of satisfactory packs which precede and/or follow the defective pack or packs.

Another object of the invention is to provide a method which can be practiced for detection and segregation of defective cigarette packs or the like from a series of rapidly advancing commodities, e.g., from a series of cigarette packs which issue from a modern high-speed packing machine and advance from the packing to the next-following processing machine.

A further object of the invention is to provide a novel and improved apparatus for the practice of the above outlined method and to construct and assemble the apparatus in such a way that it can readily discriminate between rapidly advancing defective and satisfactory commodities of a series of closely adjacent and randomly distributed satisfactory and defective commodities.

An additional object of the invention is to provide an apparatus of the just outlined character which can be used with advantage for detection and segregation of defective packs containing cigarettes or other smokers' products, especially packs which are defective on the ground that their inner, intermediate and/or outer envelopes are improperly formed, sealed and/or folded.

Another object of the invention is to provide an apparatus which can be installed in or combined with a modern high-speed packing machine for cigarettes or the like to detect and segregate defective packs at the rate at which such packs, with the satisfactory packs, issue from the packing machine on their way to a machine wherein the packs are confined in transparent or translucent envelopes consisting of cellophane and having (if necessary) customary tear strips, or to a machine which introduces groups of packs into cartons or analogous containers for predetermined numbers of packs.

An ancillary object of the invention is to provide the apparatus with novel and improved means for effecting reliable segregation of defective packs from a series of randomly distributed defective and satisfactory packs which travel at an elevated speed.

A further object of the invention is to provide the apparatus with novel and improved means which can simultaneously monitor successive packs for the presence of two or more potential defects and which can cooperate with a single ejecting device to effect removal of defective commodities from satisfactory commodities regardless of whether a commodity is defective due to the presence of a single defect or two or more identical or different defects.

Another object of the invention is to provide an apparatus which is compact, relatively simple, relatively inexpensive and requires a minimum of attention.

A further object of the invention is to provide an apparatus which automatically conforms the rate of its monitoring and ejecting operations to the varying speed of commodities which are to be monitored and, if necessary, ejected from their predetermined path.

One feature of the invention resides in the provision of a method of ascertaining the condition of and segregating defective commodities (e.g., packs for cigarettes or other types of smokers' products) from a series of discrete spaced-apart commodities which include randomly distributed satisfactory and defective commodities. The method comprises the steps of monitoring the commodities of the series and generating signals denoting defective commodities (each defect signal may be a detectable signal or the absence of a detectable signal), transporting the commodities of the series along a predetermined path (preferably but not necessarily along a substantially horizontal path which is open from below) including frictionally holding the commodities to movement along the path, and effecting removal of defective commodities from the path including changing the orientation of defective commodities in response to the respective signals so as to reduce the frictional hold upon defective commodities. The frictional hold upon defective commodities can be reduced to zero or to a value which is sufficiently low to enable the defective commodities to leave the path by gravity.

In accordance with a presently preferred embodiment of the invention, the orientation changing step includes turning defective commodities about an axis which is normal to the direction of movement of commodities along their path. For example, a defective commodity can be caused to turn about the aforementioned axis by terminating the forward progress of a first portion of the defective commodity along the path and frictionally advancing a second portion of such commodity along the path during and subsequent to termination of forward progress of the first portion.

If the commodities are of the type having major front and rear sides and frictionally engaged elongated lateral or side faces whose width is less than the width of the major sides, as considered in the longitudinal direction and transversely of the path (typical examples of such commodities are cigarette packs which are transported in such a way that their narrow end faces are disposed in two parallel horizontal planes in order to ensure that flaps or tucks which are improperly bonded or folded extend from the upper and/or lower sides of the advancing packs), the orientation changing step preferably comprises pivoting defective commodities in response to the respective defect signals about axes which are parallel to the longitudinal directions of the lateral faces and are nearer to one of these lateral faces. Defect signals are generated when the positions of flaps on certain (defective) commodities deviate from normal positions which are indicative of properly folded, tucked and/or bonded flaps. Several flaps of each commodity of the aforementioned series can be scanned simultaneous or one after the other ahead of the removing or segregating station, and a signal is generated in response to detection of each improperly positioned flap. The commodities of the aforementioned series can be scanned or monitored directly in the aforementioned path, i.e., immediately or shortly upstream of the segregating station.

The commodities are preferably transported by endless belt conveyors or like transporting means which are disposed at both sides of the path and frictionally hold the commodities during travel past the monitoring station or stations as well as toward and past the ejecting or segregating station (at least in the case of satisfactory commodities).

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a schematic plan view of an apparatus which embodies one form of the invention, the ejecting device being shown in the idle position;

FIG. 2 is a fragmentary sectional view as seen in the direction of arrows from the line II—II of FIG. 1;

FIG. 3 is a circuit diagram of electrical components of the monitoring and ejecting devices;

DESCRIPTION OF THE PREFERRED EMBODIMENTS

Figure 4:
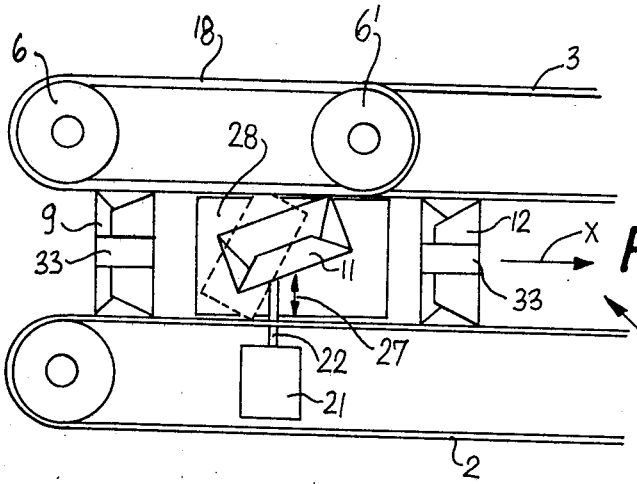
FIG. 4 is a fragmentary plan view of the apparatus, with the ejecting device in operative position and in the process of segregating a defective cigarette pack from a series of satisfactory and defective packs.

The invention will be described with reference to monitoring of a series of successive spaced-apart cigarette packs and with reference to segregation of defective cigarette packs from satisfactory cigarette packs. However, it is to be understood that the improved method and apparatus can be resorted to with equal advantage for monitoring and segregation of other types of commodities, especially all kinds of packs or analogous containers for smokers' products (which may but need not constitute or resemble rods) as well as many other types of substantially prismatic commodities which require scanning and separation of certain (e.g., defective) commodities from remaining (e.g., satisfactory) commodities.

In the embodiments which are illustrated in the drawing, the defects of certain commodities (packs) are those which are attributable to deviation of portions of envelopes from their accustomed shape, color and/or position, e.g., to absence of adequate bonds between the folds, tucks, panels or like portions of inner, intermediate or outer envelopes of so-called soft packs for plain or filter cigarettes. A conventional soft pack has an outer envelope made of paper or like foldable material which is closed at one end by two tucks and two flaps. The flaps overlie the tucks and one flap overlies the other flap. Such flaps are bonded to each other by a suitable adhesive. The paper envelope is open at the other end to expose the end portion of an inner envelope consisting of metallic foil stock. The exposed end portion of the inner envelope has two inner tucks and two outer flaps which overlie each other. In many instances, the outer flaps of the metallic foil are held in contact with each other by an adhesive-coated label which overlies the respective end of the pack and is bonded to the adjacent portions of the two major panels of the outer envelope. In a defective pack, one paper flap is likely to be movable relative (i.e., it is not bonded) to the other paper flap. Alternatively or in addition to such defect, a defective pack can lack a label so that the flaps of the metallic inner envelope do not overlie each other and/or the adjacent tucks.

The method and apparatus of the present invention can be used with equal advantage to detect and segregate cigarette packs or like commodities whose defects are due to other factors, such as to absence of printed matter on the outer envelopes, to defacing of outer envelopes, to the absence of seams which are provided on the outer envelopes of acceptable packs to connect two overlapping marginal portions to each other, to deviation of the shape of packs from a prescribed form, and/or others. All this can be readily achieved by resorting to appropriate mechanical, electromechanical, optical, electrooptical, electromagnetic, magnetic, electropneumatic and/or other detectors for selected portions or constituents of successive packs.

The apparatus which is shown in FIGS. 1, 2 and 4 comprises a transporting unit which defines an elongated straight horizontal path 1 for a series of spaced apart cigarette packs 9, 11 and 12. The illustrated packs are so-called soft packs each of which has an outer envelope 35 made of paper and including a tubular portion which surrounds an array of cigarettes (not shown) as well as a bottom end portion having two relatively narrow tucks and two relatively wide flaps of which one is shown in FIG. 2, as at 26. The upper end of the tubular portion of the paper envelope 35 is open to expose the normally closed upper end of an inner envelope consisting of metallic foil. The upper end of the inner envelope has two tucks 24*b*, 24*c* (see FIG. 1) and two flaps 24, 24*a*. The flap 24*a* normally overlies the tucks 24*b*, 24*c*, and the flap 24 normally overlies the flap 24*a*. A finished soft pack further comprises a sealing element 33 which is normally a revenue label and is pasted to the upper portions of the major panels of major walls 37, 38 of the respective paper envelopes 35 so that the median portion of the properly applied sealing element 33 holds the flap 24 against the flap 24*a* and thereby holds the flap 24*a* against the tucks 24*b*, 24*c*. The paper flap 26 is bonded to the other paper flap (not shown) at the bottom end of the respective pack by a suitable adhesive. In the absence of such adhesive, the flap 26 exhibits the tendency to move away or is actually moved away from the other paper flap at the bottom end of the paper envelope 35; such pack is considered defective and should be segregated from the other packs. As shown in FIG. 2, the median soft pack 11 is defective for two reasons, namely, the paper flap 26 extends downwardly and away from the other paper flap, and the metallic flap 24 extends upwardly and away from the adjacent flap 24*a* because the pack 11 lacks a sealing element (label) 33. The packs 9 and 12 are satisfactory.

The transporting unit which defines the path 1 for the series of packs 9, 11 and 12 includes a first endless belt conveyor 2 which is trained over upright rollers or pulleys 4 (only one shown) constituting or forming part of means for driving the inner stretch or reach 2*a* of the belt 2 in a direction to the right, as viewed in FIG. 1, 2 or 4, and a second endless belt conveyor 3 which is trained over driving means in the form of vertical rollers or pulleys 6 so that its inner reach or stretch 3*a* advances in the same direction and at the same speed as the inner reach 2*a*. The inner reaches 2*a*, 3*a* are disposed in parallel vertical planes and flank the path 1 for the packs 9, 11 and 12. The width W of the path 1 equals or is slightly less than the width of the major panels or walls 37, 38 of a pack, and the inner reaches 2*a*, 3*a* are in frictional engagement with the respective elongated vertical lateral or side faces 39, 41 of the respective packs. The end faces or top and bottom faces of the packs 9, 11 and 12 are located in parallel horizontal planes at levels above and below the belt conveyors 2, 3 of the transporting unit. The means for feeding successive packs into the path 1 may include a packing machine, e.g., a machine known as COMPAS which is manufactured and sold by the assignee of the present application. The prime mover, not shown, of the packing machine can drive the vertical shafts 7 and 8 for the respective pulleys 4 and 6 so that the movements of the inner reaches 2*a*, 3*a* of the conveyors 2, 3 are synchronized and these reaches advance successive packs sideways so that the neighboring packs are equally spaced apart from each other. The spacing SP between two neighboring packs is preferably selected in such a way that this spacing plus the thickness T of a pack, as considered in the direction of transport of the series of packs along the path 1, at least equals the width W of a pack, i.e., the distance between the inner reaches 2*a* and 3*a*. The width W exceeds the thickness T of a pack 9, 11 or 12. The height H of the packs is such that portions thereof extend upwardly above and downwardly below the upper and lower edges of the conveyors 2 and 3.

The distance between the inner reaches 2*a* and 3*a* is preferably only slightly less than the width W of a pack so as to ensure that the packs which advance along the path 1 (e.g., to a machine which applies transparent outer envelopes and, if necessary, tear strips to the satisfactory packs) are not subjected to excessive deforming stresses. The frictional hold of inner reaches 2*a* and 3*a* upon the packs 9, 11 and 12 is sufficient to normally ensure the absence of any slippage; however, the tensioning of inner reaches 2*a* and 3*a* is preferably moderate so as to permit at least some deformation of the reach 2*a* and/or 3*a* in response to a change in orientation of a defective pack (such as the pack 11, see FIG. 4) for the purpose of expelling or removing such pack from the path 1 before it can reach the next processing station.

The monitoring means for the packs 9, 11 and 12 (as well as for all packs which follow the pack 9) is adjacent to the path 1. However, it is equally within the purview of the invention to install the monitoring means upstream of the path between the inner reaches 2*a*, 3*a* and to delay the signals which are generated by the monitoring means on detection of defective packs so that such signals can be used for expulsion of corresponding defective packs from a predetermined portion of the path 1, namely, from that portion which is accessible to a reciprocable intercepting member 22 of an orientation changing device which effects removal of defective packs and further includes an electromagnetic actuator 21 for the member 22. The latter is a pin-shaped armature of the electromagnet and is movable into and from a predetermined portion of the path 1 so as to move in front of a selected portion of an oncoming defective pack whereby the pack is caused to turn about a substantially vertical axis and to reduce the extent of its frictional engagement with the inner reaches 2*a*, 3*a* of the endless belt conveyors 2 and 3.

The aforementioned monitoring means comprises a proximity detector 13 which is designed to generate electric signals in response to movement of an improperly positioned metallic or metal-coated flap 24 therealong. The exact construction of the proximity detector 13 forms no part of the invention; all that counts is to use a detector which generates an appropriate signal when it is approached by an improperly positioned flap 24, namely, by a flap which is inclined upwardly and away from the plane of the upper end of the pack therebelow. An improperly positioned flap 24 may but need not actually contact the proximity detector 13. The first or proper position of a flap 24 is that in which the flap is horizontal, and the second or unsatisfactory position of such flap is that which the flap often assumes if the corresponding pack lacks a label 33 which normally holds the flap 24 in contact with the flap 24*a* therebelow. In order to facilitate detection of flaps 24 which have assumed or can assume the unsatisfactory positions, the apparatus preferably further comprises means for shifting or displacing a flap 24 away from the corresponding flap 24*a* if such movement of the flap 24 is possible, e.g., in the absence of a label 33 on the corresponding pack. Such displacing means includes a blowing nozzle 16 which discharges a stream 17 of compressed gaseous fluid in the direction of sidewise movement of packs along the path 1 and in a plane slightly above the upper ends of satisfactory packs (such as the packs 9 and 12) so that the gaseous fluid of the stream 17 can pivot a loose flap 24 to a position in which the pivoted flap invariably moves sufficiently close to the proximity detector 13 on its way toward the ejecting station.

The monitoring means further comprises a photocell or an analogous detector for improperly positioned flaps 26 of the upper envelopes 35. The illustrated detector for unsatisfactory flaps 26 comprises a light source 14' and a photoelectronic transducer 14 which is exposed to light issuing from the source 14' when the station accommodating the detector 14, 14' is passed by a satisfactory pack (such as 9 or 12). If the flap 26 of a pack (such as the pack 11) extends downwardly because it is not pasted to the other paper flap or for another reason, the light beam which issues from the source 14' is interrupted and the transducer 14 transmits a signal which initiates or effects the ejection of the corresponding pack from the path 1.

FIG. 2 shows that the width of the belt 3 is less than the height of a pack 9, 11 or 12. Thus, portions of each pack extend upwardly and downwardly beyond the upper and lower edges of the belt 3. The transporting unit of the apparatus of FIGS. 1, 2 and 4 further comprises additional or auxiliary conveyors which are adjacent to the upper side of the path 1, as viewed in FIG. 1, and are in pronounced frictional engagement with the respective lateral or side faces 41 of the packs in the path 1. Such auxiliary or additional conveyors include endless cord or rubber conveyors 18 and 19 which have a circular or nearly circular cross-sectional outline and are respectively disposed above and below the endless belt conveyor 3. As shown in FIG. 2, the conveyors 18 and 19 are trained over the left-hand pulley or roller 6 as well as over an intermediate pulley or roller 6'. Their inner reaches are parallel to the inner reach 3*a*. The external surfaces of the conveyors 18, 19 are roughened, or such conveyors are made of a material having pronounced friction generating characteristics, in order to ensure strong frictional hold upon the lateral or side faces 41 of packs 9, 11, 12 in the path 1.

Figure 6:
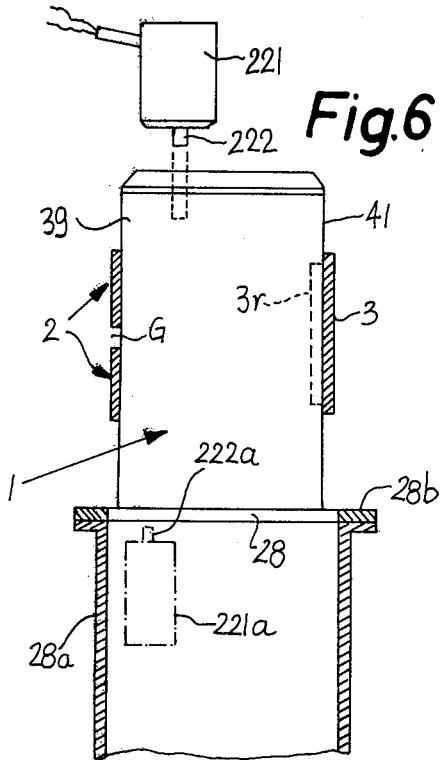
FIG. 6 is a fragmentary transverse vertical sectional view of an apparatus with two ejecting devices one of which is installed at a level above and the other of which is installed at a level below the path of satisfactory and defective commodities.
Figure 8:
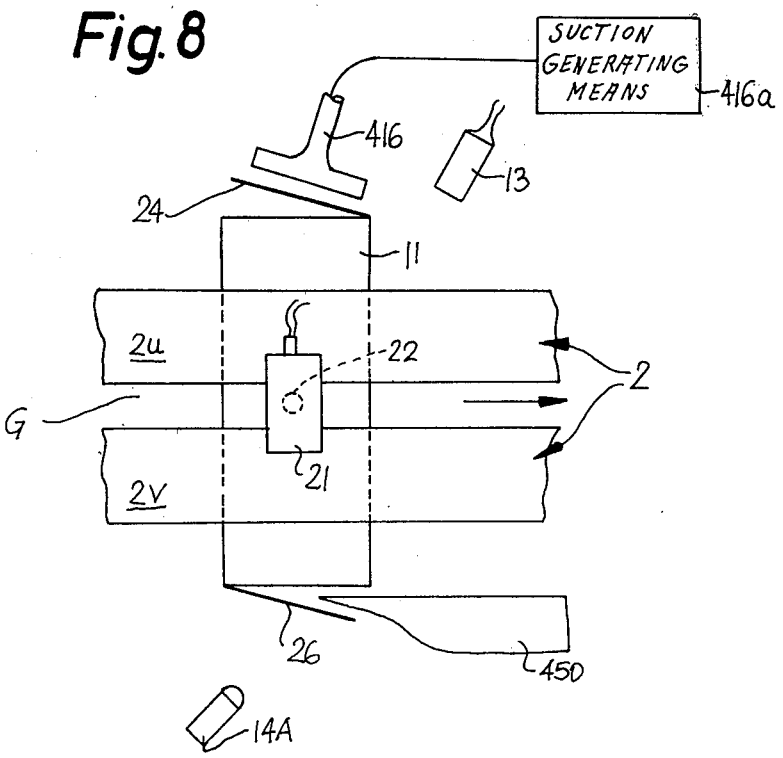
FIG. 8 is a fragmentary side elevational view of a further apparatus wherein the detection of defective commodities is facilitated by a suction generating device and/or by mechanical means.

As shown in FIGS. 6 and 8, the endless belt conveyor 2 consists of two spaced-apart sections 2*u* and 2*v* which define a gap G through which the intercepting member 22 of the ejecting device can extend into the path 1 in response to energization of the electromagnet 21, i.e., in response to generation of a signal on detection of a defective pack (such as the pack 11). The path 1 is open at a level below the ejecting station (see the opening 28 in a platform 28*b* on which the undersides of the packs can but need not slide on their way along the path 1) so that a defective article whose orientation with respect to the conveyors 2, 3, 18, 19 has been changed by the intercepting member 22 can descend by gravity to leave the path 1 and to enter a chute 28*a* (shown in FIG. 6) for automatic transport to a collecting bin or to a station where the cigarettes (or at least the tobacco particles of such cigarettes) are recovered for reintroduction into the filter tipping machine (or for reintroduction into the distributor of the cigarette making machine).

FIG. 3 is a schematic circuit diagram which illustrates the operative connections between the monitoring means and the electromagnet 21 of the ejecting device. Such connection comprises conductors 15 which connect the output of the proximity detector 13 and the output of the photoelectronic transducer 14 with an amplifier 23 for the electromagnet 21. If desired, the monitoring means can comprise at least one additional detector (such as a further photocell 45) which also transmits defect signals to the amplifier 23 and serves to scan successive packs (in or ahead of the path 1) for other types of defects, e.g., for the presence of smudges on the paper envelopes 35, for the absence of printed matter on such envelopes, for deviation of the shape of packs from a prescribed norm, and/or others. The amplifier 23 amplifies the defect signal from the proximity detector 13, transducer 14 and/or photocell 45 and transmits the amplified signal to the electromagnet 21 which is energized for a certain interval of time so as to move the intercepting member 22 through the gap G and into the adjacent portion of the path 1 in front of the front panel 37 of the corresponding defective pack, namely, of that defective pack whose monitoring resulted in the generation and transmission of a signal to the amplifier 23 and thence to the electromagnet 21.

The operation of the apparatus which embodies the features of FIGS. 1 to 4 is as follows:

The packs 9, 11 and 12 (as well as the packs which follow the pack 9) are soft packs for the customary arrays of twenty cigarettes each (each such array contains two spaced parallel outer rows of seven cigarettes each and a median row of six cigarettes whose articles are staggered with respect to the articles of the outer rows). The packs issue from a cigarette packing machine and are fed into the left-hand end of the path 1 in the illustrated orientation so that the conveyor 2 engages the lateral or side faces 39 and the conveyors 3, 18, 19 engage the lateral or side faces 41 of the packs. These conveyors engage the paper envelopes 35. As mentioned above, the path 1 can discharge satisfactory or acceptable packs (such as the packs 9 and 12) into a further machine (not shown) which provides each pack with a transparent outer envelope which is formed with or can include a customary tear strip.

The upper and lower ends of the packs 9 and 12 are properly closed and sealed; therefore, the proximity detector 13 and the transducer 14 do not generate any signals during travel of the packs 9 and 12 therealong. However, the metallic flap 24 of the pack 11 is inclined upwardly, and such improper positioning of the flap 24 (which is attributed or attributable to the absence of a revenue label 33 on the pack 11) is enhanced by the fluid stream 17 which issues from the nozzle 16 and flows in the direction of movement of packs along the path 1. At the same time, the transducer 14 of the photocell 14, 14' generates a defect signal as a result of detection of the downwardly extending (improperly positioned) flap 26 of the paper envelope 35 on the pack 11. As mentioned above, improper positioning of the flap 26 is attributable (or can be attributed) to the absence of a reliable bond between the flap 26 and the other flap at the lower end of the envelope 35.

The detector 13 and the transducer 14 transmit defect signals to the amplifier 23 which energizes the electromagnet 21 so that the intercepting member 22 is moved to the extended position of FIG. 4, namely, through the gap G between the sections 2*u*, 2*v* of the conveyor 2 and into the adjacent portion of the path 1. The extended intercepting member 22 moves into the path of forward movement of that portion of the pack 11 which is nearer to the inner reach 2*a* of the conveyor 2. Since the frictional engagement between the pack 11 and the conveyor 2 at the lower side of the path 1, as viewed in FIG. 4, is less pronounced than the frictional engagement between the packs and the conveyor means 3, 18, 19 at the upper side of the path, as viewed in FIG. 4, the conveyors 3, 18, 19 continue to advance the respective portion of the pack 11 while the lower portion of the pack 11 remains arrested. The resulting change in orientation of the pack 11 is attributable to rotation about a vertical axis which is normal to the plane of FIG. 4 and is nearer to the inner reach 2*a* than to the inner reach 3*a* and the inner reaches of the conveyors 18, 19. The change of orientation takes place above the opening 28 of the platform 28*b* so that the released pack 11 can descend by gravity and enters the chute or duct 28*a*. The intercepting member 22 is retracted to the inoperative position of FIG. 1 before it could interfere with forward movement of the oncoming satisfactory pack 9. The directions in which the intercepting member 22 is reciprocable are indicated by the double-headed arrow 27 of FIG. 4. An intermediate position of the defective pack 11 (which this pack assumes shortly after the extended intercepting member 22 has begun to change its orientation with reference to the conveyor means 2, 3, 18, 19) is shown in FIG. 4 by broken lines. The frictional engagement between the pack 11 and the conveyors 3, 18, 19 is sufficiently pronounced to ensure further movement of the corresponding portion of the pack 11 after the lower portion of the pack (as viewed in FIG. 4) is intercepted and held by the member 22 against further movement in the direction of the arrow X. The intercepting member 22 can be a flat strip or a round post or stud, depending on its location with reference to the upper and lower ends of the packs in the path 1. In many instances, a small-diameter rod-like intercepting member will suffice, especially if it is located exactly or substantially midway between the upper and lower ends of successive packs in the path 1. The aforementioned axis about which the pack 11 is turned in response to movement of the intercepting member 22 to the extended position of FIG. 4 is nearer to the inner reach 2*a* than to the inner reach 3*a;* furthermore, such axis is normal to the direction which is indicated by the arrow X, and such axis is parallel to the planes of the inner reaches 2*a*, 3*a*. The extent to which the intercepting member 22 projects into the path 1 in response to energization of the electromagnet 21 can be readily selected in such a way that the pack 11 is disengaged from all four conveyors (2, 3, 18, 19) before it advances beyond the opening 28 in the platform 28*b*, i.e., that the defective pack invariably descends by gravity to leave the path 1 and enter the chute or duct 28*a*.

The inner side of the inner reach 2*a* of the conveyor 2 may but need not be very smooth. All that counts is to ensure that this inner reach can cooperate with the conveyors 3, 18, 19 to properly advance satisfactory packs 9, 12 without slippage but to allow for rapid disengagement of (reduction of frictional hold upon) defective packs so that such packs can be evacuated from the path 1 in a predetermined portion of the path, namely, above the opening 28.

Figure 5:
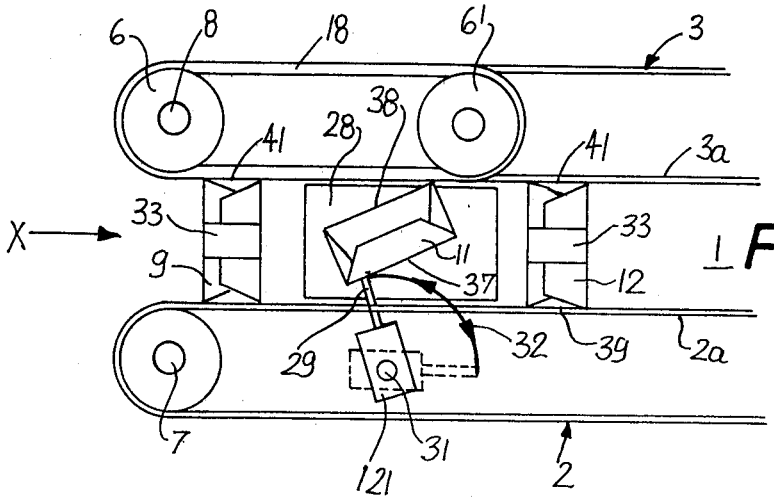
FIG. 5 is a fragmentary plan view of an apparatus with a modified ejecting device which is pivotable about a vertical axis.

FIG. 5 shows a portion of a modified apparatus. All such parts of this apparatus which are clearly analogous to or identical with the corresponding parts of the apparatus of FIGS. 1 to 4 are denoted by similar reference characters. The main difference between the two apparatus is that the intercepting member 29 of the ejecting device of FIG. 5 need not be retracted by its electromagnet 121; instead, the electromagnet 121 is a rotary electromagnet which can turn about the axis of a vertical pivot member 31. The axis of this pivot member is parallel to the axes of the shafts 7 and 8. The arrow 32 indicates the directions of back-and-forth pivotal movement of the intercepting member 29 into and from the path 1 between the inner reaches 2*a*, 3*a* of the belt conveyors 2 and 3. If desired, the electromagnet 121 can be replaced by a simple holder for the intercepting member 29; the pivot member 31 then forms part of the means for rotating the holder and the intercepting member 29, either back and forth (as indicated by the arrow 32) or in a single direction (e.g., counterclockwise, as viewed in FIG. 5) in order to move the tip of the intercepting member 29 into engagement with the adjacent portion of an oncoming defective pack 11 and to retract or remove the member 29 from the path 1 before the ejecting station is reached by the oncoming foremost satisfactory or acceptable pack 9. The pack 11 of FIG.

5 is assumed to be defective for the reason or reasons which were explained in connection with the pack 11 shown in FIG. 2. The starting or idle position of the intercepting member 29 is shown in FIG. 5 by broken lines.

The embodiment of FIG. 5 again comprises the additional endless conveyors 18, 19 (only the conveyor 18 is shown) in order to ensure the establishment of a more pronounced frictional engagement with the lateral or side faces 41 of successive packs than between the inner reach 2*a* and the lateral or side faces 39. The extent of back and forth pivotal movement of the intercepting member 29 can range from less than 90 degrees to more than 90 degrees (as shown in FIG. 5). If the member 31 is designed to rotate the holder and the intercepting member 29 in a single direction, each angular displacement of the intercepting member 29 preferably amounts to a full revolution.

The apparatus of FIG. 5 can be modified by placing the ejecting device in such position that the intercepting member 29 engages the rear panel 38 of a defective pack. This would be tantamount to rotating the member 31 counterclockwise while at the same time advancing the packs 9, 11 and 12 in a direction to the left, as viewed in FIG. 5. The speed of angular movement of the intercepting member 29 about the axis of the pivot member 31 is then increased so as to ensure that the orientation of a defective pack is changed, that such defective pack leaves or practically leaves the path 1, and that the member 29 is withdrawn from the path 1 before the oncoming satisfactory pack (12 in FIG. 5) reaches the ejecting station. The speed of the conveyors 2, 3 and 18, 19 is preferably constant, i.e., that portion of a defective pack which is remote from the conveyor belt 2 advances at a constant speed for a certain interval of time following engagement between the member 29 and the defective pack.

The mounting of the ejecting device in a manner as shown in FIG. 5, i.e., so that the intercepting member 29 enters the path 1 ahead of the oncoming defective commodity (11), is preferred at this time because the orientation of the defective commodity can be changed more rapidly. The placing of the ejecting device in such position that the member 29 engages a defective commodity from behind exhibits the advantage that the member 29 can remain in the path 1 for a longer interval of time because it has a component of movement in the direction of the arrow X, i.e., in the direction of movement of the commodities along the path 1. In FIG. 5, the member 29 decelerates the respective portion of the oncoming defective commodity. On the other hand, if the member 29 is to engage a defective commodity from behind, it must accelerate the respective portion of the commodity (close to the conveyor 2).

As mentioned above, and as described in connection with the detector 45 of FIG. 3, the apparatus of the present invention can be used to detect any one (or two or more) of a wide variety of defects of cigarette packs or other commodities which are transported at spaced intervals so as to provide room for a change in orientation of the defective commodities at the ejecting or segregating station. All that counts is to ensure that the intercepting means can be retracted from the path for the commodities before it could interfere with forward progress of a satisfactory commodity and that the spacing between neighboring commodities suffices to enable a defective commodity to turn about a vertical axis (if the path is horizontal or nearly horizontal) which is preferably nearer to that side of the path where the frictional hold of the respective conveyor means upon the corresponding lateral or side faces of the packs is less pronounced than at the other side. The width W of a pack should exceed the thickness T, and it is preferred that the combined thickness T and space SP at least equal the width W.

Rather pronounced frictional engagement between the conveyor 3 or conveyors 3, 18, 19 and the respective portion of a defective commodity during a change of orientation of such commodity is desirable and advantageous because this reduces the likelihood of slippage of the defective commodity relative to the conveyor 3 or conveyors 3, 18, 19 (or vice versa) during ejection of the defective commodity. Slippage of the conveyors 3, 18, 19 relative to the corresponding portion of the defective commodity or vice versa during ejection of such commodity is undesirable because such slippage would prolong the interval of ejection and could cause the defective commodity to interfere with the forward progress of the oncoming satisfactory commodity.

Of course, excessive frictional engagement between the commodities (especially if the commodities are cigarette packs and even more particularly if the commodities are soft packs) is also undesirable for several reasons. For example, the conveyors 2, 3 should be capable of sliding relative to the satisfactory packs in the path 1 if a satisfactory pack encounters an obstruction downstream of the ejecting station so that it is arrested and acts a stop against the forward progress of the next-following satisfactory packs. Relatively weak frictional engagement between the conveyors 2, 3 and the lateral or side faces 39, 41 of the satisfactory packs normally suffices to ensure the transport of such packs to the discharge end of the path 1 in the absence of any obstruction or obstructions which would prevent further forward progress of satisfactory packs. It will be noted that the conveyors 18, 19 (whose frictional engagement with the respective lateral or side faces 41 of the packs is more pronounced than the engagement between the packs and the inner reaches 2*a*, 3*a*) extend only to the downstream end of the ejecting station (i.e., to the downstream end of the opening 28 in the platform 28*b*). Were the conveyors 18, 19 to extend beyond the ejecting station, they could prevent stoppage of satisfactory packs in the path 1 downstream of the ejecting station in response to entry of an obstruction in front of a satisfactory pack which has already advanced beyond the range of the intercepting member.

As explained above, and as shown in the drawing, it suffices if the conveyors 2 and 3 engage (or at least the conveyor 3 engages) only the central portions of the lateral or side faces 39 and 41 of successive packs in the path 1. This renders it possible to place one of the conveyors 18, 19 above and to place the other of these conveyors below the conveyor 3. Such distribution of conveyors at that side of the path 1 which is remote from the intercepting member 22 or 29 ensures more uniform engagement of the respective portion of a defective commodity by the conveyors 3, 18, 19 and reduces the likelihood of unpredictable forward movement (or of absence of forward movement) of such portion of a defective commodity during change of orientation of the defective commodity. The speed of the conveyors 18, 19 matches that of the conveyor 2 or 3. As a rule, all of the conveyors will be driven at a constant speed; however, such speed can be changed automatically if the conveyors are driven by the main prime mover of a packing machine, i.e., the speed of the conveyors then varies as a function of changes of the output of the packing machine. This ensures that the spacing between neighboring (randomly distributed satisfactory and defective) packs in the path 1 remains unchanged even if the speed of movement of the conveyors 2, 3, 18 and 19 is changed.

FIG. 6 shows that the apparatus can comprise an ejecting device with an electromagnet 221 and an intercepting member 222 which is normally disposed at a level above the path of commodities between the inner reaches of the conveyors 2 and 3. The electromagnet 221 is energized by the signal(s) from one or more detectors of the monitoring means on detection of a defective pack to move the intercepting member 222 downwardly to the broken-line position of FIG. 6 in order to change the orientation of the defective commodity and to cause such commodity to enter the duct 28*a* via opening 28 in the platform 28*b*. The intercepting member 222 is nearer to the inner reach of the conveyor 2 than to the inner reach of the conveyor 3.

If desired, and in order to ensure even more predictable turning of defective packs about a vertical axis which is closer to the belt conveyor 2 than to the belt conveyor 3, the apparatus may comprise two intercepting members which are coaxial to each other and are respectively disposed above and below the path of the commodities between the belt conveyors 2 and 3. This is shown in FIG. 6 wherein the lower ejecting device including an electromagnet 221*a* and an intercepting member 222*a* is indicated by phantom lines. The intercepting member 221*a* rises into the path of packs or analogous commodities simultaneously with downward movement of the intercepting member 222. Such simultaneous engagement of a defective pack or the like from above as well as from below practically eliminates any likelihood of unpredictable changes of orientation of defective packs during disengagement from the conveyors.

The conveyors 18, 19 can be omitted (see FIG. 6) if the inner side of the inner reach of the belt 3 is treated in such a way that its frictional hold upon the respective lateral or side faces 41 of commodities in the path 1 is more or much more pronounced than the frictional hold of the inner reach 2*a* upon the lateral or side faces 39. Still further, the conveyor 3, 18 and/or 19 can be provided with spaced-apart projections which constitute entraining elements for the packs in the path 1. All such modifications will be readily understood without further illustrations. Nevertheless, FIG. 6 shows that the conveyors 18, 19 are omitted and that the conveyor belt 3 carries entraining ribs 3*r* (one shown) which engage the rear panels of the respective packs in the path 1.

An advantage of the apparatus of FIGS. 1–5 over the apparatus of FIG. 6 is that the single ejecting device occupies less room. On the other hand, the two intercepting members of the apparatus shown in FIG. 6 bring about a more reliable and predictable change of orientation of each defective commodity by causing such commodity to turn about an axis which is nearer to the belt conveyor 2 than to the belt conveyor 3. Each ejection will or can entail some stretching or flexing of the conveyors; however, such stretching or flexing need not be sufficiently pronounced to bring about a change in orientation of a satisfactory commodity which precedes or follows a defective commodity. This holds true even if successive commodities of the series are rather closely adjacent to each other, i.e., if the spacing between neighboring commodities barely suffices to allow for unimpeded turning of a defective commodity without altering the position of the preceding or the next-following commodity.

Figure 7:
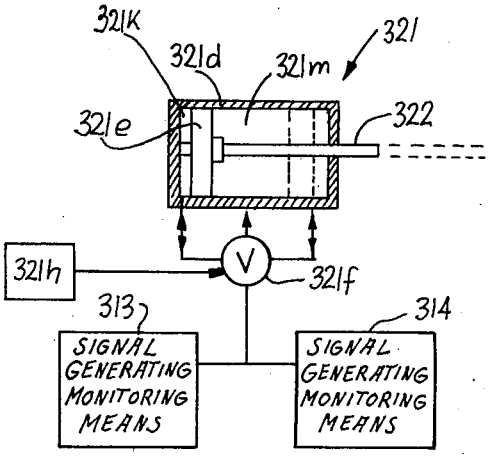
FIG. 7 illustrates the details of a fluid-operated ejecting device.

FIG. 7 illustrates a further ejecting device wherein the intercepting member 322 is reciprocable by fluid-operated motor means 321. The motor means 321 includes a double-acting pneumatic cylinder 321*d* for a piston 321*e* which is connected to the intercepting member 322. A valve 321*f* which is responsive to signals from the signal generating monitoring means 313 and/or 314 is further connected with a source 321*h* of compressed gaseous fluid. When the monitoring means 313 and/or 314 transmits a signal denoting the detection of a defective commodity, the valve 321*f* connects the source 321*h* with the left-hand chamber 321*k* of the cylinder 321*d* and connects the right-hand chamber 321*m* with the atmosphere. The intercepting member 322 is then moved to its extended position which is indicated by broken lines. The interval of connection of the chamber 321*k* to the source 321*h* is relatively short to ensure that the intercepting member 322 is retracted from the path for the commodities before it is reached by an oncoming acceptable commodity.

FIG. 8 shows that the blowing nozzle 16 of FIG. 1 or 2 can be replaced with a suction nozzle 416 which draws a stream of air upwardly and away from the upper side of each passing commodity. If the flap 24 of the oncoming commodity is not held in position by a properly applied label, the suction generating means 416*a* (e.g., a blower) causes the nozzle 416 to lift the flap 24 into the range of the proximity detector 13 which generates a defect signal and effects the ejection of the respective commodity (pack 11 in FIG. 8) from the path between the two groups of conveyors (only the conveyor 2 is shown in FIG. 8).

FIG. 8 further illustrates a mechanical device 450 (e.g., a stationary wedge-like implement) for moving the flaps 26 of defective packs (11) to positions in which such flaps can be readily detected by the monitoring means. The wedge-like mechanical device 450 folds the flap 26 downwardly so that the latter deflects light which issues from the light source of a photocell 14A back toward the light source and upon the photosensitive surface of the transducer (not specifically shown). This causes the photocell 14A to generate a defect signal which is amplified (if necessary) and transmitted to the electromagnet 21 whereby the latter moves its armature (intercepting member) 22 through the gap G and into the path between the belt conveyor 2 and the other conveyor or conveyors of the transporting unit in the apparatus of FIG. 8.

Figure 9:
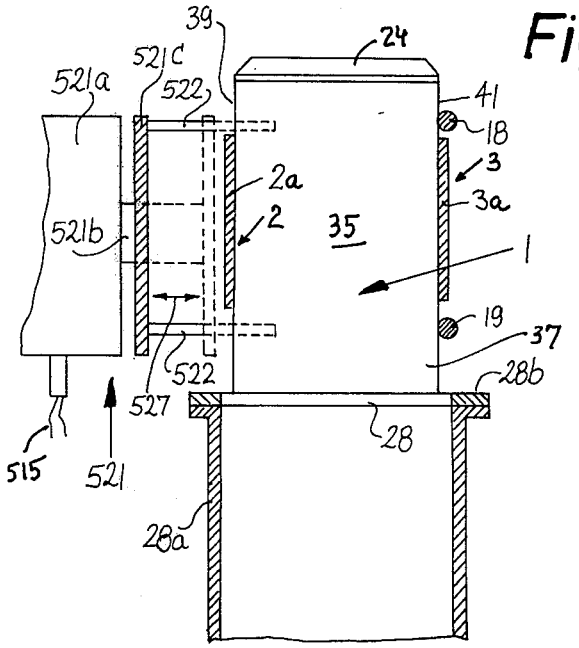
FIG. 9 is a schematic transverse vertical sectional view of still another apparatus.

FIG. 9 illustrates an apparatus wherein all such parts which are identical with or clearly analogous to corresponding parts of the apparatus of FIGS. 1 to 4 are denoted by similar reference characters. The means 521 for effecting removal of defective commodities from the path 1 comprises an electromagnetic actuator 521*a* whose armature 521*b* is reciprocable in directions indicated by the arrow 527 and is provided with a carrier or a crosshead 521*c* for two orientation changing or intercepting pins 522. The distance between the pins 522 exceeds the width of the inner reach 2*a* of the conveyor 2 (which may but need not be assembled of two sections corresponding to the sections 2*u*, 2*v* shown in FIG. 8). When the electromagnetic actuator 521*a* is energized in response to signals which are transmitted via conductor means 515, the crosshead 521*c* is moved from the retracted position which is shown by solid lines to the extended position which is indicated by broken lines whereby the pins 522 penetrate into the left-hand portion of the path 1, as viewed in FIG. 9, to arrest the respective portion of an oncoming defective commodity, such as a cigarette pack. The pins 522 engage the respective portions of the defective commodity at levels above and below the reach 2*a* of the conveyor 2, such reach being located in a vertical plane. Thus, these pins are respectively adjacent to the upper and lower edge faces of the reach 2*a*. Since they engage the respective portion of a defective commodity at two spaced-apart locations close to the inner reach 2*a* (i.e., nearer to the conveyor 2 than to the conveyors 3, 18 and 19), they invariably ensure that the defective commodity changes its orientation and descends into the duct 28*a*. It will be noted that the function of the pins 522 of the means 521 shown in FIG. 9 is analogous to the function of coaxial pins 222, 222*a* shown in FIG. 6. If desired, the electromagnetic actuator 521*a* for the armature 521*b* can be replaced by a double-acting hydraulic or pneumatic cylinder and piston unit. The piston rod of such unit then performs the function of the armature 521*b*. It is also possible to employ an actuator with a pinion and a reversible electric motor which latter can drive the pinion clockwise or counterclockwise. The armature 521*b* is then replaced by a toothed rack which mates with the pinion and can move the crosshead 521*c* and pins 522 in directions which are indicated by the arrow 527.

The pins 522 are preferably (but need not be) parallel to each other and preferably (but not necessarily) extend at right angles to the direction of movement of commodities along the path 1 between the conveyor 2 on the one hand and the conveyors 3, 18, 19 on the other hand. The monitoring means which transmit(s) signals to the acutator 521*a* via conductor means 515 may be identical with the previously described monitoring means. The conductor means 515 an be replaced by conduit means if the monitoring means includes means for transmitting signals in the form of hydraulic or pneumatic impulses.

The manner in which the conveyors 3, 18, 19 continue to transport the respective portion of a defective commodity when such commodity is engaged by the extended pins 522 is the same as or analogous to that described in connection with FIGS. 1–4. It goes without saying that the pins 522 are withdrawn from the path 1 before they could interfere with forward movement of a satisfactory commodity toward, above and beyond the upper end of the duct 28*a*.

The means for displacing loose flaps 24 and/or 26 to positions which even more strongly deviate from desired or normal positions, so that such flaps can be more readily detected by mechanical, optical, electrical, magnetic or other suitable sensing or monitoring means, constitute optional components of the improved apparatus. The provision of such displacing means is desirable and advantageous, especially when the appartatus is operated at a relatively high speed, because they ensure that each and every defective commodity is detected without fail and is ejected from the path 1 ahead of the next-following processing station. It goes without saying that the entire apparatus can employ one and the same type of means for displacing misoriented flaps to positions in which such flaps can be more readily detected by the corresponding monitoring means. Thus, the apparatus can employ two or more blowing nozzles 16, two or more suction nozzles 416, two or more mechanical devices 450, or any suitable combination or combinations of these devices with each other or with other types of analogous devices for rendering the defects more readily detectable by the monitoring means. Each of the illustrated displacing means serves to spread the oncoming improperly positioned flap away from the remainder of the defective pack. The one-piece mechanical displacing device 450 of FIG. 8 can be replaced by one or more finger- or tongue-like displacing elements, not shown.

As concerns the construction of the monitoring means and the operative connection or connections between such monitoring means and the ejecting device, the improved apparatus is susceptible of many additional modifications without departing from the spirit of the invention. For example, the proximity detector 13 can be placed below the path 1 and the photosensitive detector 14, 14' can be placed above such path. Also, the apparatus can employ several identical detectors or two or more different detectors to monitor one and the same portion of each of a series of successive commodities in or ahead of the path 1. Several monitoring means for the flaps 24 can be used for the purpose of even more reliably ascertaining each and every soft pack which lacks a revenue label 33 so that the metallic flap 24 of the inner envelope of such pack is likely to open on its way from the packing machine to the next processing station.

An important advantage of the improved apparatus is that its reliability exceeds that of heretofore known apparatus. Moreover, the improved apparatus is very simple, compact, inexpensive and requires a minimum of maintenance. The apparatus can be readily installed in or combined with existing machines for the making and/or processing of packs for cigarettes or other commodities which constitute or form part of rod-shaped or otherwise configurated smokers' products. The apparatus does not damage or deface satisfactory commodities, and its mode of operation is such that it can reliably segregate defective packs from a series of rather closely adjacent packs which advance at a substantial speed. Furthermore, and though the drawing merely shows defects at the two ends of certain cigarette packs, the nature of monitoring means for packs or analogous commodities can be selected practically at will, i.e., the apparatus can segregate commodities which are defective due to the presence of improperly positioned or inclined metallic or paper flaps, tucks, labels, seems or the like as well as due to other defects which can be detected by mechanical, optical or other scanning or detecting means.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for ascertaining the condition of and segregating defective commodities from a series of discrete spaced apart commodities, comprising means for transporting the commodities of said series along a predetermined path including conveyor means engaging the commodities at the opposite sides of said path and means for driving said conveyor means so as to advance the commodities in a predetermined direction; means for monitoring the condition of successive commodities of said series, including means for generating signals denoting the defective commodities; and means for effecting removal of defective commodities from said path in response to said signals, including means for changing the orientation of defective commodities with reference to said conveyor means to thereby reduce the force with which said conveyor means engage the defective commodities, said orientation changing means including means for turning defective commodities about axes which are nearer to one than to the other side of said path.

2. The apparatus of claim 1 for ascertaining the condition of and segregating defective commodities from a series of discrete spaced apart commodities having a thickness, as considered in said direction, which is less than the width thereof, as considered transversely of said direction, wherein said axes are at least substantially normal to said direction.

3. The apparatus of claim 2, wherein at least a portion of said path is open from below and said orientation changing means is arranged to reduce said force to zero, at said least at one side of said path, so that the turned defective commodities can leave said path by gravity.

4. The apparatus of claim 3, wherein said conveyor means includes first and second endless flexible conveyors disposed at the opposite sides of said path and having elongated reaches which are disposed in substantially vertical planes and normally engage the adjacent portions of commodities in said path.

5. The apparatus of claim 4, wherein the commodities are substantially prismatic bodies, particularly packs for smokers' products, having elongated side faces engaged by said reaches, front and rear panels extending transversely of said path, and relatively small top and bottom end faces.

6. The apparatus of claim 5, wherein the spacing between neighboring commodities in said path plus the thickness of a commodity at least equals the distance between said reaches.

7. The apparatus of claim 1, wherein said conveyor means includes a plurality of discrete conveyors in frictional engagement with the commodities in said path.

8. The apparatus of claim 1, wherein said conveyor means includes a plurality of discrete endless flexible conveyors and said driving means includes rotary elements, said conveyors being trained about said rotary elements and such elements being rotatable about substantially vertical axes.

9. The apparatus of claim 8, wherein said conveyors have elongated parallel reaches which flank said path, at least that one of said reaches which is adjacent to said one side of said path being disposed in a predetermined plane and said axes being substantially parallel to the plane of said one reach and normal to said direction.

10. The apparatus of claim 1, wherein said turning means comprises an intercepting member which is movable into and from said path and means for moving said intercepting member into said path in response to said signals.

11. The apparatus of claim 10, wherein said means for moving said intercepting member includes electromagnet means.

12. The apparatus of claim 10, wherein said means for moving said intercepting member includes a fluid-operated motor.

13. The apparatus of claim 12, wherein said motor is a pneumatic cylinder and piston unit.

14. The apparatus of claim 10, wherein said moving means includes a device for imparting to said intercepting member a reciprocatory movement into and from said path.

15. The apparatus of claim 10, wherein said moving means includes a device for rotating said intercepting member into and from said path.

16. The apparatus of claim 15, wherein said rotating means includes means for rotating said intercepting member in a single direction.

17. The apparatus of claim 15, wherein said rotating means includes means for rotating said intercepting member back and forth into and from said path.

18. The apparatus of claim 1, wherein said conveyor means includes first and second endless belt conveyors disposed at the opposite sides of said path and said driving means includes pulleys which are rotatable about substantially vertical axes, said belt conveyors being trained about the respective pulleys.

19. The apparatus of claim 1, wherein said turning means is nearer to said one side of said path and said conveyor means includes first and second conveyor means respectively disposed at said one and said other side of said path, said first conveyor means including at least one endless conveyor which is in frictional engagement with the respective portions of commodities in said path and said second conveyor means including at least one endless conveyor which is in more pronounced frictional engagement with the respective portions of commodities in said path.

20. The apparatus of claim 1, wherein said conveyor means includes a first endless belt conveyor in frictional engagement with commodities at said one side of said path, a second endless belt conveyor in frictional engagement with commodities at said other side of said path, and at least one third endless conveyor in more pronounced frictional engagement with commodities at said other side of said path, said turning means being nearer to said one than to said other side of said path.

21. The apparatus of claim 1, wherein said turning means is nearer to said one side of said path and said conveyor means includes a first endless belt conveyor frictionally engaging the commodities at said one side of said path, a second endless belt conveyor frictionally engaging the commodities at said other side of said path, and two additional endless conveyors frictionally engaging the commodities at said other side of said path with a force exceeding the force of frictional engagement between said first conveyor and the commodities, said second conveyor being disposed between said additional conveyors.

22. The apparatus of claim 21, wherein said conveyors have elongated parallel reaches which engage the commodities at the respective sides of said path.

23. The apparatus of claim 1, wherein said turning means is nearer to said one side of said path and said conveyor means comprises at least one endless conveyor having an elongated stretch which frictionally engages the commodities at said other side of said path opposite said turning means, said endless conveyor having a substantially circular cross-sectional outline.

24. The apparatus of claim 23, wherein said endless conveyor is an endless cord or rubber conveyor.

25. The apparatus of claim 1, wherein said conveyor means includes an endless conveyor having an elongated reach engaging the commodities at said one side of said path, said reach having two spaced apart sections and said turning means including an intercepting member in register with the gap between said sections of said reach and means for moving said intercepting member into and from said path between said sections.

26. The apparatus of claim 25, wherein the combined width of said sections of said reach is such that portions of the commodities in said path extend outwardly beyond each said sections substantially at right angles to said direction.

27. The apparatus of claim 1 for ascertaining the condition of and segregating defective commodities from a series of discrete spaced apart randomly distributed satisfactory and defective commodities of the type having flaps which are located in first positions on satisfactory commodities and are movable to second positions on defective commodities, further comprising displacing means for effecting the movement of flaps to second positions on defective commodities of said series.

28. The apparatus of claim 27, wherein said monitoring means includes at least one detector arranged to scan the commodities of said series for the presence of flaps in said second positions, said monitoring means being located downstream of said displacing means, as considered in the direction of movement of commodities toward and/or along said path.

29. The apparatus of claim 27, wherein said displacing means includes means for generating at least one stream of gaseous fluid which tends to move the flaps to second positions.

30. The apparatus of claim 29, wherein said displacing means includes a blow nozzle.

31. The apparatus of claim 29, wherein said displacing means includes suction generating means and at least one suction nozzle connected with said suction generating means and arranged to draw said fluid stream in a direction to thereby move the flaps of defective commodities to said second positions.

32. The apparatus of claim 27, wherein said displacing means includes mechanical displacing means.

33. The apparatus of claim 1, wherein said monitoring means includes at least one proximity detector.

34. The apparatus of claim 1, wherein said monitoring means comprises at least one photosensitive detector.

35. The apparatus of claim 1, wherein said monitoring means is adjacent to said path.

36. The apparatus of claim 1, wherein said conveyor means includes at least one first conveyor which engages the commodities of said series at said one side of said path and at least one second conveyor which engages the commodities at said other side of said path opposite said one side, said turning means including two intercepting members flanking said first conveyor and means for moving said intercepting members into said path to engage the adjacent portion of an oncoming defective commodity and for maintaining said intercepting members outside of said path during passage of satisfactory commodities past said intercepting members.

37. The apparatus of claim 36, wherein said first conveyor includes an elongated reach which is located in a substantially vertical plane and engages the commodities of said series at said one side of said path, said intercepting members including first and second pins which are respectively disposed at a level above and at a level below said reach.

38. The apparatus of claim 36, wherein said means for moving said intercepting members includes electromagnet means.

39. The apparatus of claim 38, wherein said electromagnet means includes a reciprocable armature and further comprising carrier means secured to said armature and supportingly connected with said intercepting members.

40. The apparatus of claim 36, wherein said intercepting members are at least substantially parallel to each other.

41. The apparatus of claim 36, wherein said intercepting members include pins which extend substantially at right angles to the direction of movement of commodities along said path.

42. A method of ascertaining the condition of and segregating defective commodities of a series of discrete spaced apart commodities, comprising the steps of monitoring the commodities of said series and generating signals denoting defective commodities; transporting the commodities of said series along a predetermind path including frictionally holding the commodities at the opposite sides of said path so as to normally compel the commodities to move along said path; and effecting removal of defective commodities from said path, including changing the orientation of defective commodities in response to the respective signals so as to reduce the frictional hold upon the defective commodities, said orientation changing step including turning defective commodities about axes which are nearer to one than to the other side of said path.

43. The method of claim 42, wherein said axes are normal to the direction of movement of commodities along said path.

44. The method of claim 42, wherein said orientation changing step further includes reducing the frictional hold upon defective commodities to zero and allowing the thus released defective commodities to leave said path by gravity.

45. The method of claim 42, wherein said turning step includes terminating the forward progress of a first portion of each defective commodity along said one side of said path and frictionally advancing a second portion of such commodity along said other side of said path during and subsequent to termination of said forward progress.

46. The method of claim 42 of ascertaining the condition of and segregating defective commodities from a series of spaced apart randomly distributed satisfactory and defective commodities of the type having major front and rear sides and frictionally engaged elongated lateral faces whose width is less than the width of said major sides, as respectively considered in the direction and transversely of said path, wherein said axes are parallel to the longitudinal directions of said lateral faces.

47. The method of claim 46, wherein said commodities include flaps and wherein the positions of flaps on defective commodities deviate from the positions of corresponding flaps on satisfactory commodities, said monitoring step including scanning successive commodities of said series for the positions of their flaps and generating signals when the positions of scanned flaps are indicative of defective commodities.

48. The method of claim 47, wherein said monitoring step comprises scanning several flaps of each of said series of commodities and generating signals in response to detection of each flap whose position is indicative of a defective commodity.

49. The method of claim 42, wherein said monitoring step includes scanning successive commodities of said series in said path.

* * * * *